US012679593B2

(12) United States Patent
Bailey et al.

(10) Patent No.: US 12,679,593 B2
(45) Date of Patent: Jul. 14, 2026

(54) HALF-BARREL KEG PALLET

(71) Applicant: Anheuser-Busch, LLC, St. Louis, MO (US)

(72) Inventors: Christopher J. Bailey, Cartersville, GA (US); Carl E. Schuldt, St. Louis, MO (US)

(73) Assignee: Anheuser-Busch, LLC, St. Louis, MO (US)

( * ) Notice: Subject to any disclaimer, the term of this patent is extended or adjusted under 35 U.S.C. 154(b) by 84 days.

(21) Appl. No.: 18/639,754

(22) Filed: Apr. 18, 2024

(65) Prior Publication Data

US 2024/0351741 A1 Oct. 24, 2024

Related U.S. Application Data

(60) Provisional application No. 63/460,495, filed on Apr. 19, 2023.

(51) Int. Cl.
*B65D 19/00* (2006.01)

(52) U.S. Cl.
CPC ..... *B65D 19/0016* (2013.01); *B65D 2519/00034* (2013.01); *B65D 2519/00069* (2013.01); *B65D 2519/00268* (2013.01); *B65D 2519/00288* (2013.01); *B65D 2519/00318* (2013.01); *B65D 2519/00333* (2013.01); *B65D 2519/0096* (2013.01)

(58) Field of Classification Search
CPC ..... B65D 19/0016; B65D 2519/00034; B65D 2519/00069; B65D 2519/00268; B65D 2519/00288; B65D 2519/00318; B65D 2519/00333; B65D 2519/0096; B65D 7/045
USPC ..... 108/53.5, 51.11, 53.1, 57.13, 57.16, 901, 108/53.3; 206/386, 599, 821
See application file for complete search history.

(56) References Cited

U.S. PATENT DOCUMENTS 3,563,184 A * 2/1971 Angelbeck, Jr. ... B65D 19/0014 108/53.5
3,636,888 A * 1/1972 Angelbeck, Jr. ... B65D 71/0096 108/55.3
3,995,749 A * 12/1976 Haskins ..... B65D 19/44 206/821
8,424,469 B2 * 4/2013 Shuert ..... B65D 19/0075 108/57.27

(Continued)

FOREIGN PATENT DOCUMENTS

BE 1013907 A3 * 12/2002 ..... B65D 19/0014
DE 102006037482 A1 * 2/2008 ..... F16F 15/08

*Primary Examiner* — Janet M Wilkens
(74) *Attorney, Agent, or Firm* — Husch Blackwell LLP

(57) ABSTRACT

A pallet having a pair of shoulders raised from opposing sides of a deck, a pair of legs extending downwardly from the sides of the deck, and a third leg extending downwardly from a central portion of the deck, the third leg having at least one foot. The shoulders including an inner upper seating surface and an outer upper seating surface. The pair of legs each including an inner support surface vertically offset from an outer support surface. The inner upper seating surface and the outer upper seating surface of the pallet configured to cooperate with the outer support surface of each of the pair of legs of a second pallet stacked atop the pallet to align the two pallets to one another such that the legs of the second pallet do not disengage from the first pallet.

20 Claims, 11 Drawing Sheets

(56) References Cited

U.S. PATENT DOCUMENTS

| | | | | |
|---|---|---|---|---|
| 9,611,071 | B2 * | 4/2017 | Baltz | B65D 19/44 |
| 9,901,172 | B2 * | 2/2018 | Linares | B65D 3/04 |
| 2006/0272556 | A1 * | 12/2006 | Apps | B65D 19/004<br>108/53.1 |

* cited by examiner

HALF-BARREL KEG PALLET

CROSS REFERENCE TO RELATED APPLICATIONS

This application claims the benefit of U.S. Provisional Application No. 63/460,495, titled "HALF-BARREL KEG PALLET," filed on Apr. 19, 2023, which is incorporated by reference in its entirety.

FIELD

Aspects provided relate to a pallet for storing and/or transporting goods. More specifically, aspects relate to a pallet for stacking cylindrical containers.

BACKGROUND

Pallets have been used to store and transport goods, including half-barrel kegs. Previous pallet designs would support four half-barrel kegs in a two-by-two arrangement on a cargo surface positioned between peripheral stop members raised from the cargo surface. The cargo surface was supported above a base surface (e.g., a floor) by support members positioned under the cargo surface.

Half-barrel keg pallets are typically in one of two use configurations. The first being the loaded configuration, where up to four half-barrel kegs are stowed atop the cargo surface. The second being the unloaded configuration, where a plurality of pallets are stacked atop one another. In large packaging operations where the pallets move from the unloaded configuration to the loaded configuration, the top pallet of the stack is automatically engaged, moved, and loaded.

SUMMARY

At a high level, a half-barrel keg pallet may include a deck, a pair of shoulders raised from the deck, each of the shoulders having an inner seating surface and an outer seating surface, and a pair of legs, each of the legs having an outer support surface and a lower seating surface, where the seating surfaces of the shoulders of a first pallet cooperate with the support and seating surfaces of the legs of a second pallet to align the second pallet atop the first pallet when the pallets are in an unloaded stacked condition.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
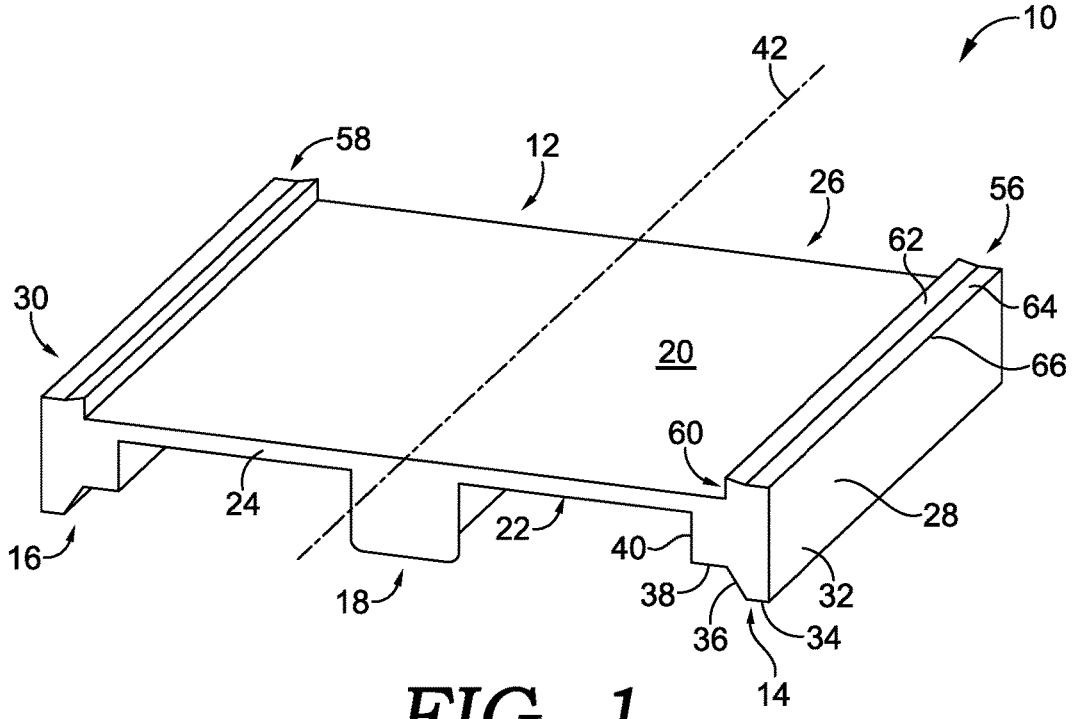
FIG. 1 depicts a perspective view of a pallet from above, in accordance with aspects hereof.
Figure 2:
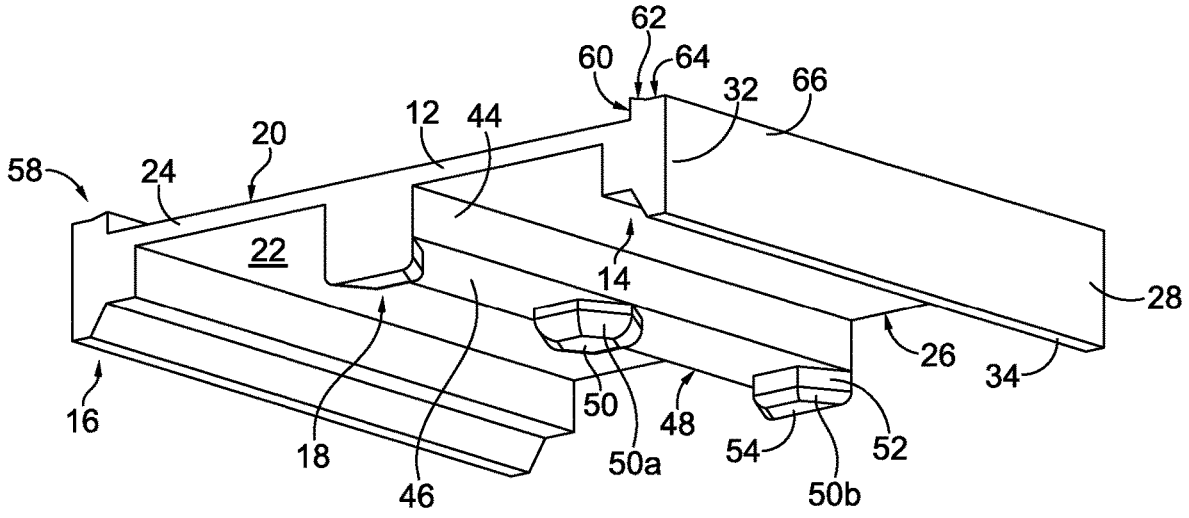
FIG. 2 depicts a perspective view of the pallet from FIG. 1 from below, in accordance with aspects hereof.
Figure 3:
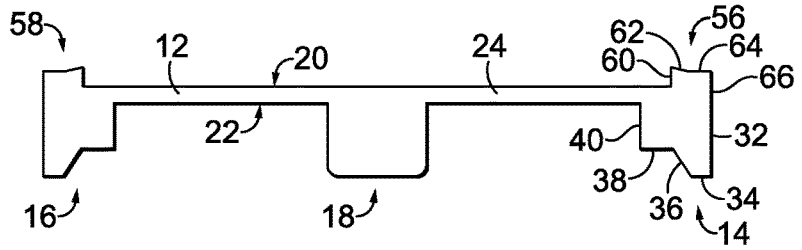
FIG. 3 depicts a front elevation view of the pallet from FIG. 1, in accordance with aspects hereof.
Figure 4:
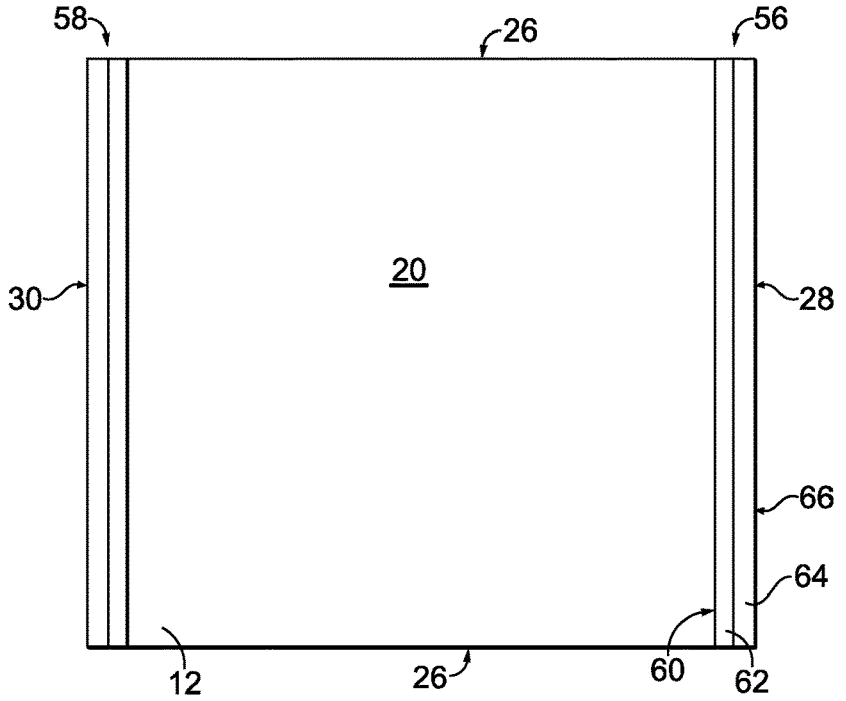
FIG. 4 depicts a top view of the pallet from FIG. 1, in accordance with aspects hereof.
Figure 5:
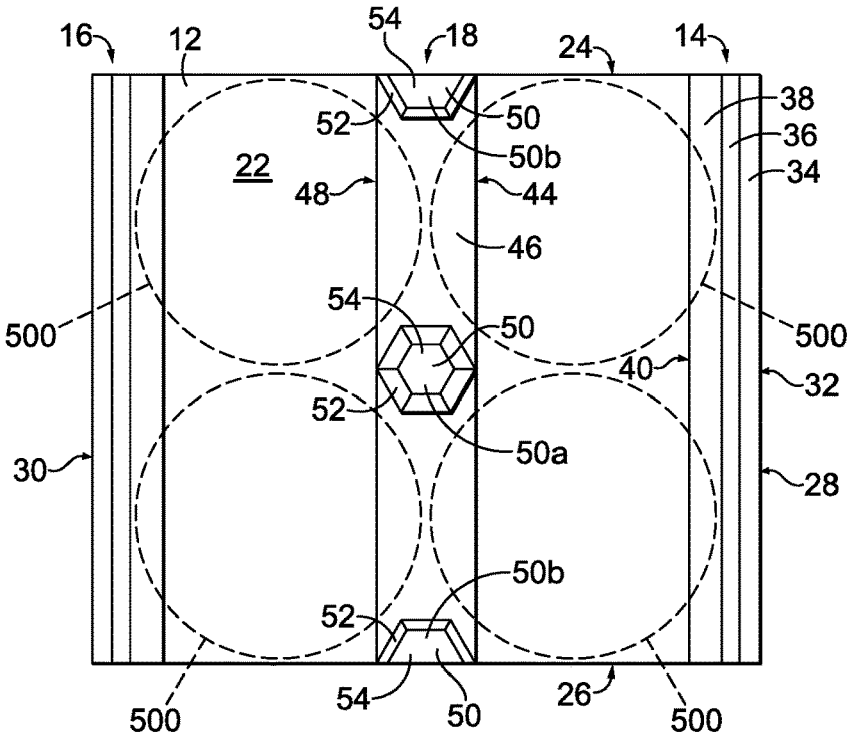
FIG. 5 depicts a bottom view of the pallet from FIG. 1, in accordance with aspects hereof.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Further, it should be appreciated that the figures do not necessarily represent an all-inclusive representation of the embodiments herein and may have various components hidden to aid in the written description thereof.

Aspects hereof may be described using directional terminology. For example, the Cartesian coordinate system may be used to describe positions and movement or rotation of the features described herein. Accordingly, some aspects may be described with reference to three mutually perpendicular axes. The axes may be referred to herein as lateral, longitudinal, and vertical, and may be indicated by reference characters X, Y, and Z, respectively, in the accompanying figures. For example, the terms "vertical" and "vertically" as used herein refer to a direction perpendicular to each of the lateral and longitudinal axes. Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Additionally, the term "distal" refers to a portion of a feature herein that is positioned away from a midpoint of the feature.

At a high level, a half-barrel keg pallet may include a deck, a pair of shoulders raised from the deck, each of the shoulders having an inner seating surface and an outer seating surface, and a pair of legs, each of the legs having an outer support surface and a lower seating surface, where the seating surfaces of the shoulders of a first pallet cooperate with the support and seating surfaces of the legs of a second pallet to align the second pallet atop the first pallet when the pallets are in an unloaded stacked condition.

Although described herein in reference to half-barrel kegs, this disclosure also applies to any cylindrical cargo loaded on a pallet.

Turning now to the figures generally, and in particular to FIGS. 1-5, a pallet 10 is depicted from different perspectives in an unloaded state. The pallet 10 is configured to be loaded with up to four half-barrel kegs in a two-by-two configuration. Once loaded, a second pallet (see FIG. 6) may be positioned atop the half-barrel kegs where it too may be loaded with up to four half-barrel kegs. Thus, the bottom structure of the pallet 10 must include portions adapted to cooperate with half-barrel kegs in a way that a second pallet can also be loaded with additional half-barrel kegs. As more fully described below, the pallet 10 may include a pair of legs having multiple support surfaces (e.g., a ground contacting surface and a keg lip contacting surface).

In addition, it is contemplated that this process may be repeated one or more times such that the stack of loaded pallets may be up to ten rows high (i.e., a stack may include up to 40 half-barrel kegs). Thus, the pallet 10 positioned on the bottom of the stack must be strong enough to withstand the weight of the entire stack. As more fully described below, the pallet 10 may include a third leg having multiple support surfaces (e.g., a ground contacting surface and a keg lip contacting surface) which inhibits the pallet from bowing.

Further, loading of pallets may be automated. In these aspects, a stack of unloaded pallets may be positioned near a loading station. Then, a top pallet may be transferred from the stack to the loading station and up to four half-barrel kegs may be loaded on the pallet. This process benefits from the top pallet being in a consistent position relative to the stack of unloaded pallets and/or the loading station. Previous pallets included legs on either side of the pallet that could become misaligned with the pallet immediately beneath. For example, one side may have become too far offset to one side such that the leg slipped off a side edge of the pallet immediately beneath such that the top pallet became crooked relative to the intended position. In this instance, the loading operation is likely to be suspended and the pallets would be re-aligned before loading could resume. This could cause a major delay if the misaligned pallet was positioned lower in the stack due to the increased weight of the pallets stacked thereon. As more fully described below, the pallet 10 may include a pair of shoulders raised from a deck surface that include alignment surfaces that are configured to cooperate with the support surfaces of a pallet stacked thereon and limit the pallet stacked thereon from becoming misaligned.

The pallet 10 includes a deck 12, a first leg 14 positioned on a first side of the pallet 10, a second leg 16 positioned on a second side of the pallet 10. In aspects, the second leg 16 may be a mirror image of the first leg 14. The pallet 10 further includes a third leg 18, which may be positioned proximate a center-line of the pallet 10 in a front-to-back direction.

The deck 12 includes a top surface 20 opposite a bottom surface 22 and extends from the top surface 20 to the bottom surface 22 in a vertical direction, from a front side 24 to a rear side 26 in a front-to-back direction, and from a first side 28 to a second side 30 in a side-to-side direction. The illustrated aspect depicts the deck 12 being solid. In other aspects, the deck 12 may not be solid (e.g., continuous structure) and may include structures that provide an effective top surface in order to save material (e.g., such as where the deck includes slots, channels, apertures, perforations but presents an effective top surface upon which cargo is supported). Further, the deck 12 may include one or more drain ports that extend through the deck 12 from the top surface 20 to the bottom surface 22. In still other aspects, the top surface 20 may include a small slope and/or channels such that liquid may be encouraged to drain off portions of the top surface 20 while still maintaining the top surface nearly parallel to the surface upon which the pallet 10 is set upon.

The deck 12 may be comprised of a polymer composition. A polymer composition includes, but is not limited to: low-density polyethylene (LDPE), high-density polyethylene (HDPE), polypropylene (PP), polyvinyl chloride (PVC), polystyrene (PS), nylon, polytetrafluoroethylene, polyamide, and thermoplastic polyurethanes (TPU). In some aspects, the entire pallet 10 may be comprised of the same polymer composition. In other aspects, one or more portions of the deck 12 may be comprised of a different material from the other portions of the pallet 10. The different material may provide increased surface roughness as compared against the material of the rest of the pallet 10. The surface roughness may be tested using any standardized surface roughness test (e.g., ASTM D7127, ISO 4287-1:1984, etc.). In still other aspects, the top surface 20 may be coated with a substance (e.g., sand, quartz, polymer-based compositions, metallic materials) to increase a friction coefficient associated with the top surface 20.

Figure 8:
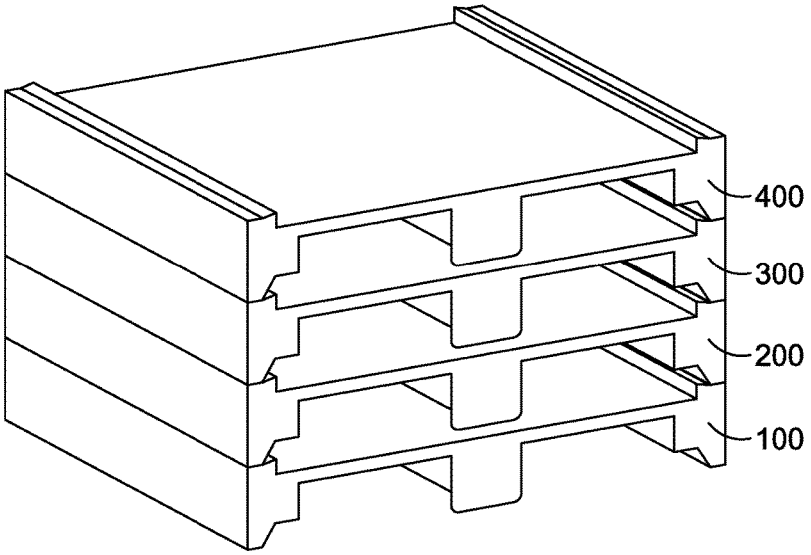
FIG. 8 depicts a perspective view of four unloaded pallets in a stack, in accordance with aspects hereof.
Figure 9:
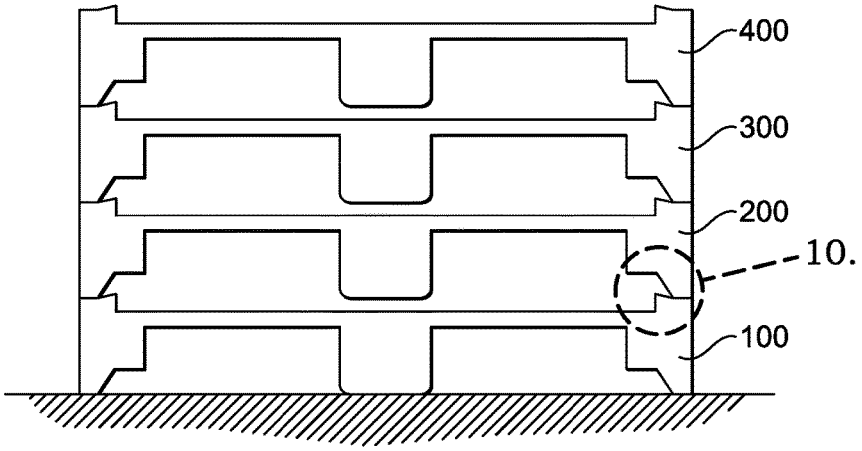
FIG. 9 depicts a front elevation view of the four unloaded pallets from FIG. 8, in accordance with aspects hereof.

The first leg 14 extends downwardly from the bottom surface 22 of the deck 12. In the illustrated aspect, the first leg 14 includes an outer leg vertical surface 32 extending downwardly to an outer support surface 34. While the term vertical is used in this specification and in the claims for ease of reference to the accompanying figures, such term is not intended to be limiting. It is not intended that relative position/direction terms (e.g., "vertical") are limited to a position/direction upon which the pallet 10 is positioned (e.g., a horizontal structure set upon, such as a floor) or of cargo set upon the pallet 10 (e.g., a horizontal surface of a keg) and merely represent an additional surface of the feature described. The outer support surface 34 is configured to engage a surface upon which the pallet 10 is placed upon, when not atop half-barrel kegs. For example, the outer support surface 34 may engage a floor surface of a warehouse or a top portion of a second pallet it may be stacked upon, among other types of surfaces. Extending inwardly and upwardly from the outer support surface 34 is a lower seating surface 36. The lower seating surface 36 helps align the pallet 10 when it is stacked upon a second pallet, as discussed below. The lower seating surface 36 terminates at an inner support surface 38. The inner support surface 38 is configured to engage half-barrel kegs when the pallet 10 is placed atop said kegs. For example, the inner support surface 38 may sit atop a rim of one or more of said kegs. Having the inner support surface 38 vertically offset from the outer support surface 34 provides a vertical space savings when two or more loaded pallets are stacked upon one another (e.g., allows stacking of loaded pallets in lower ceiling clearance warehouses). This vertical offset between the inner support surface 38 and the outer support surface 34 also allows for a stack of pallets 10 to nest (e.g., as seen in FIGS. 8 and 9), which provides lateral stability. The illustrated aspect includes an inner leg vertical surface 40 that returns to the bottom surface 22 of the deck 12.

In the illustrated aspect, the first leg 14 is a solid structure that extends from the front side 24 to the rear side 26 and is integral to the deck 12. In other aspects, the first leg 14 may be a separate structure joined to the deck 12 (e.g., fastened, affixed, welded, otherwise coupled). In still other aspects, the first leg 14 may extend only a portion of the distance between the front side 24 and the rear side 26. For example, the first leg 14 may be separated into a plurality of segments that are separated by gaps.

The illustrated aspect depicts the first leg 14 having a front surface coplanar with the front side 24, a rear surface coplanar with the rear side 26, and the outer leg vertical surface 32 coplanar with the first side 28. In other aspects, these surfaces of the first leg 14 may be offset from the respective sides of the deck 12.

As discussed above, the second leg 16 may include identical structure to that disclosed with respect to the first leg 14, mirrored across a center line 42 of the pallet 10. For sake of brevity, a description of this duplicate structure of the second leg 16 will not be repeated.

The third leg 18 also extends downwardly from the bottom surface 22 of the deck 12. The third leg 18 may be generally centered on pallet 10. The third leg 18 may include a first side vertical surface 44 extending down to an upper support surface 46. The upper support surface 46 is configured to engage half-barrel kegs when the pallet 10 is placed atop said kegs. For example, the upper support surface 46 may sit atop a rim of one or more of said kegs. The upper support surface 46 extends laterally across to a second side vertical surface 48. The second side vertical surface 48 returns to the bottom surface 22 of the deck 12. In the illustrated aspect, the upper support surface 46 of the third leg 18 and the inner support surface 38 of the first leg 14 and that of the second leg 16 are each spaced away from the bottom surface 22 of the deck 12 an equal distance.

The third leg 18 also includes at least one foot 50 extending downwardly from the upper support surface 46. The at least one foot 50 having a side surface 52 and a lower support surface 54. In the illustrated aspect, the pallet 10 includes a full foot **50*a* aligned with a center of the pallet 10 and two half feet 50*b* aligned with the front side 24 and the rear side 26, respectively, of the deck 12. The half feet 50*b* are positioned at the edges of the pallet 10 and thus may only extend into a void between two kegs 500 while the full foot 50*a* may extend into a void between four kegs 500 (shown in hidden lines in FIG. 5). This configuration allows each of the at least one foot 50 to extend down into voids between half-barrel kegs (which are generally circular) loaded on a second pallet beneath the pallet 10 in a two-by-two configuration. Thus, in this way the pallet 10 may be set upon said kegs such that an outer portion of at least one of the kegs 500 (seen in FIG. 6) engages the inner support surface 38 of the first leg 14 and an outer portion of another of the kegs 500 engages the inner support surface of the second leg 16 and an inner portion of the kegs 500 engages the upper support surface 46 of the third leg 18**.

In the illustrated aspect, the lower support surface 54 of each of the at least one foot 50 and the outer support surface 34 of the first leg 14 and that of the second leg 16 are each spaced away from the bottom surface 22 of the deck 12 an equal distance. In aspects, the lower support surface 54 and the outer support surface 34 are coplanar. This spacing provides additional load bearing support to the pallet 10 when it is placed on a base surface (e.g., a ground, floor, etc. of a warehouse) at the bottom of a stack of loaded pallets. The third leg 18 carries some of the weight from the stack and limits the pallet 10 from bowing down.

Like the first leg 14 and the second leg 16, the third leg 18 may have a front surface coplanar with the front side 24, a rear surface coplanar with the rear side 26, and the outer leg vertical surface 32 coplanar with the first side 28. In other aspects, these surfaces of the first leg 14 may be offset from the respective sides of the deck 12. Similarly, in other aspects the third leg 18 may extend only a portion of the distance between the front side 24 and the rear side 26. For example, the third leg 18 may be separated into a plurality of segments separated by gaps.

The pallet 10 also includes a first shoulder 56 positioned on the first side 28 of the pallet 10, a second shoulder 58 positioned on a second side 30 of the pallet 10. In aspects, the second shoulder 58 may be a mirror image of the first shoulder 56.

The first shoulder 56 extends upwardly from the top surface 20 of the deck 12. In the illustrated aspect, the first shoulder 56 includes an inner vertical surface 60 extending upwardly to an inner upper seating surface 62. The inner upper seating surface 62 extends outwardly and downwardly to an outer upper seating surface 64. The inner upper seating surface 62 helps align the pallet 10 when it is stacked upon a second pallet, as discussed below. The outer upper seating surface 64 extends outwardly to an outer vertical surface 66. The outer upper seating surface 64 provides a surface upon which a second pallet may engage when the pallet 10 is in an unloaded state. The outer vertical surface 66 returns to the top surface 20 of the deck 12. In the illustrated aspect, the outer vertical surface 66 is coplanar with the first side 28 of the deck 12 and the outer leg vertical surface 32. In other aspects, the first shoulder 56 may be offset from the first side 28.

In the illustrated aspect, the first shoulder 56 is a continuous structure that extends from the front side 24 to the rear side 26 and is integral to the deck 12. In other aspects, the first shoulder 56 may be a separate structure joined to the deck 12 (e.g., fastened, affixed, welded, otherwise coupled). In still other aspects, the first shoulder 56 may extend only a portion of the distance between the front side 24 and the rear side 26. For example, the first shoulder 56 may be separated into a plurality of segments separated by one or more gaps.

As discussed above, the second shoulder 58 may include identical structure to that disclosed with respect to the first shoulder 56, mirrored across the center line 42 of the pallet 10. For sake of brevity, a description of this duplicate structure of the second shoulder 58 will not be repeated.

Figure 6:
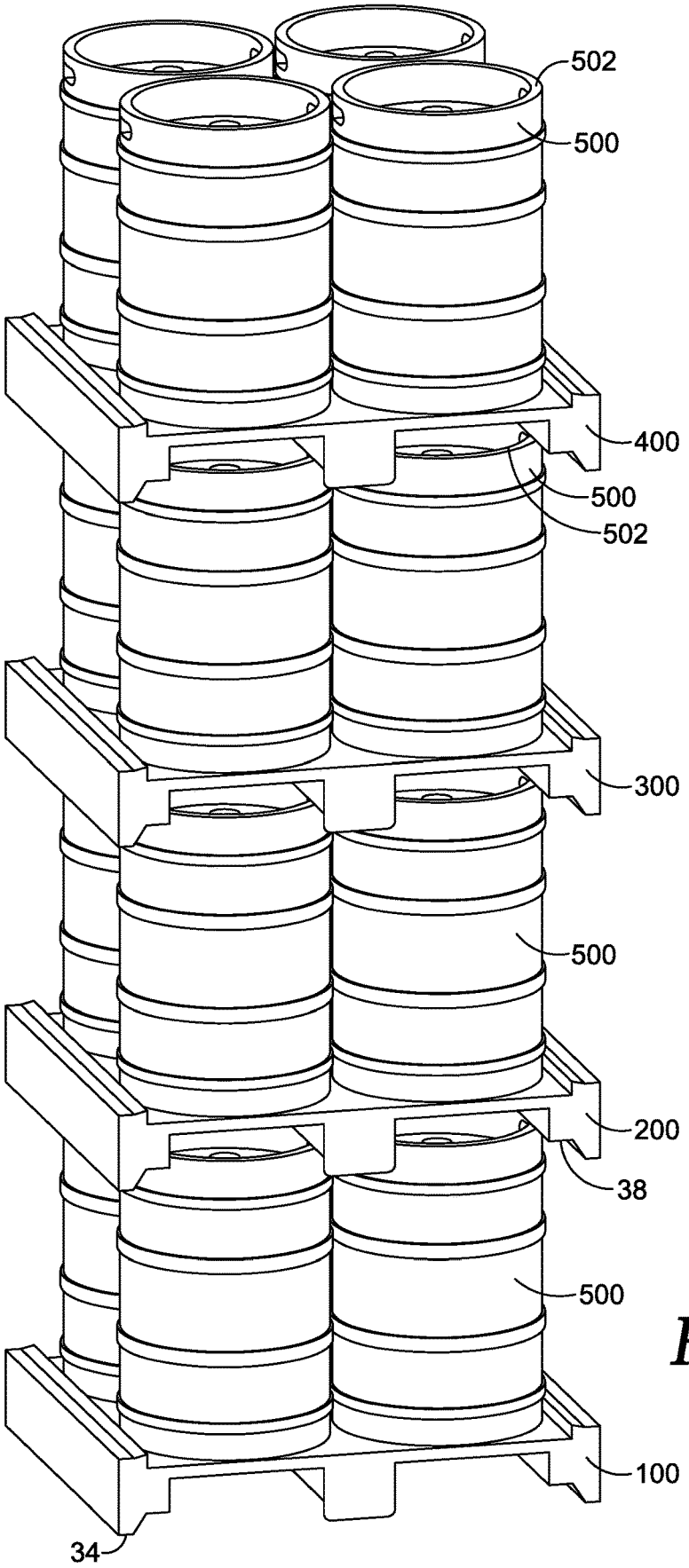
FIG. 6 depicts a perspective view of pallets loaded with half-barrel kegs with second, third, and fourth pallets stacked atop kegs positioned thereunder, in accordance with aspects hereof.
Figure 7:
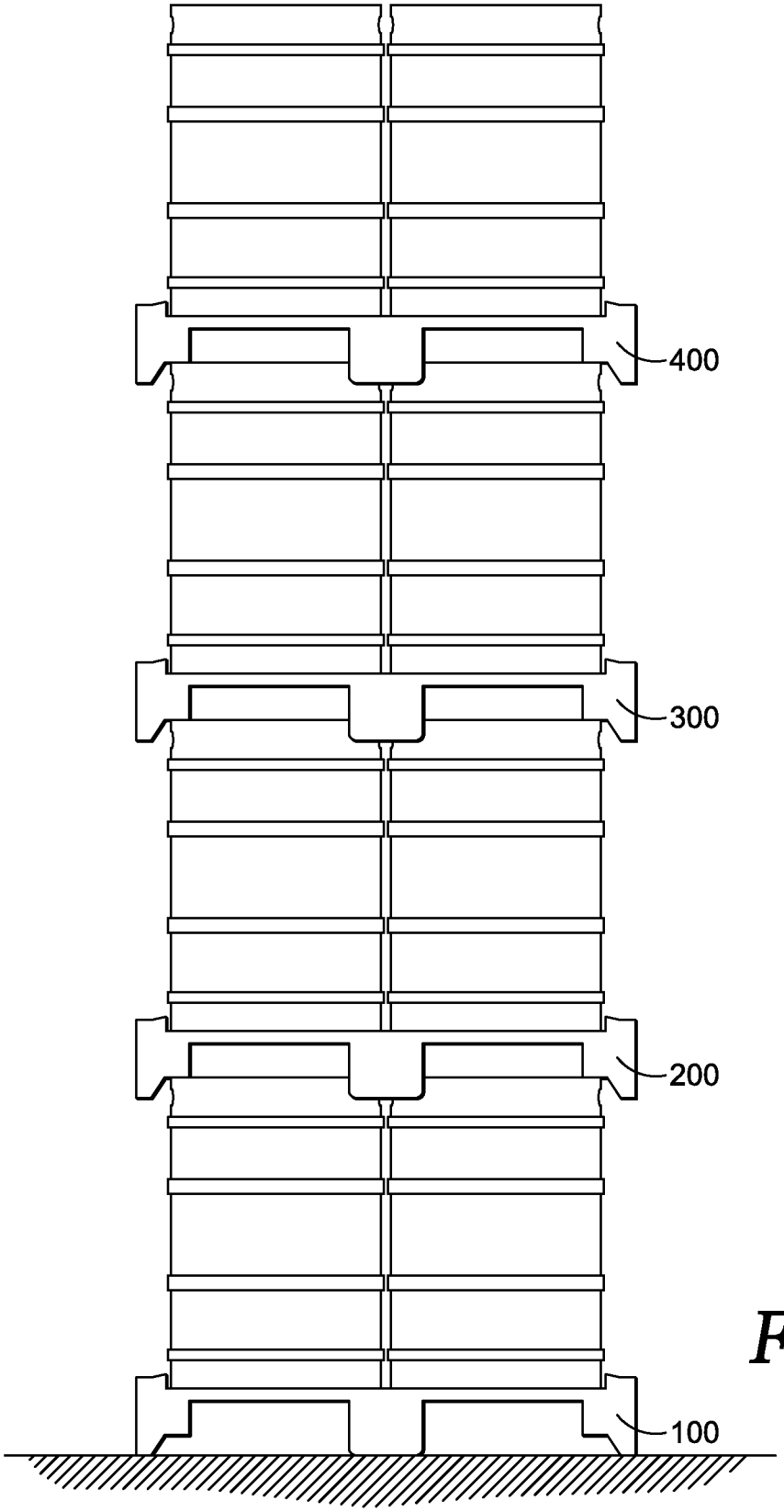
FIG. 7 depicts a front elevation view of the pallets loaded with half-barrel kegs from FIG. 6, in accordance with aspects hereof.

Turning now to FIGS. 6 and 7, a first pallet 100, a second pallet 200, a third pallet 300, and a fourth pallet 400 are depicted in a loaded stack. That is, four half-barrel kegs 500 are depicted loaded onto each of the first pallet 100, the second pallet 200, the third pallet 300, and the fourth pallet 400. Each of these pallets includes the structure and surfaces described above in reference to the pallet 10 and like reference numbers will be repeated in reference to these figures.

The four half-barrel kegs 500 are arranged in a two-by-two configuration where two kegs 500 are proximate each of the front side 24, the rear side 26, the first side 28, and the second side 30 of each of the pallets. As seen, each of the kegs 500 is positioned between the first shoulder 56 and the second shoulder 58 atop the top surface 20 of the deck 12.

The first pallet 100 is shown engaged with a base surface. For example, the first pallet 100 may be set upon a warehouse floor. The second pallet 200 is set upon the kegs 500 loaded on the first pallet 100. More specifically, the inner support surface 38 of the first leg 14 and the second leg 16 and the upper support surface of the third leg 18 of the second pallet 200 are engaged with a top surface 502 of the kegs 500 loaded on the first pallet 100. The third pallet 300 is set upon the top surface 502 of the kegs 500 loaded on the second pallet 200. More specifically, the inner support surface 38 of the first leg 14 and the second leg 16 and the upper support surface of the third leg 18 of the third pallet 300 are engaged with the kegs 500 loaded on the second pallet 200. The fourth pallet 400 is set upon the top surface 502 of the kegs 500 loaded on the third pallet 300. More specifically, the inner support surface 38 of the first leg 14 and the second leg 16 and the upper support surface of the third leg 18 of the fourth pallet 400 are engaged with the kegs 500 loaded on the third pallet 300. The at least one foot 50 of each of the second pallet 200, third pallet 300, and fourth pallet 400 are nested between the half-barrel kegs 500 loaded on the pallet below.

Figure 10:
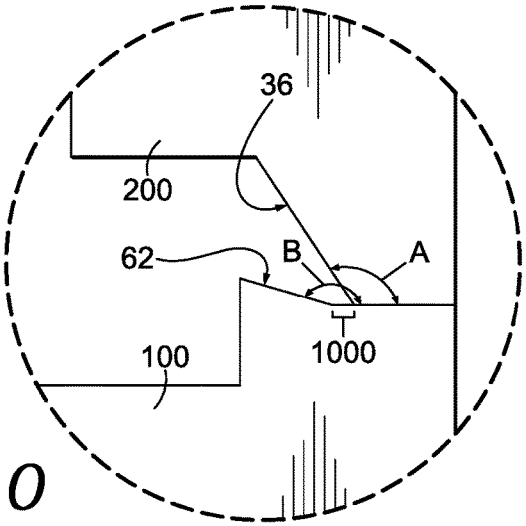
FIG. 10 depicts a section view of a first leg of a first pallet engaging a first shoulder of a second pallet, in accordance with aspects hereof.

Turning now to FIGS. 8-10, the first pallet 100, the second pallet 200, the third pallet 300, and the fourth pallet 400 are depicted in an unloaded stack. The first pallet 100 is shown engaged with a base surface. For example, the first pallet 100 may be set upon a warehouse floor, a pallet loading machine proximate a loading station, or the like. The second pallet 200 is set upon the first pallet 100. More specifically, the outer support surface 34 of the first leg 14 and the second leg 16 of the second pallet 200 are engaged with the outer upper seating surface 64 of the first shoulder 56 and the second shoulder 58 of first pallet 100.

Likewise, the third pallet 300 is set upon the second pallet 200. More specifically, the outer support surface 34 of the first leg 14 and the second leg 16 of the third pallet 300 are engaged with the outer upper seating surface 64 of the first shoulder 56 and the second shoulder 58 of second pallet 200. The fourth pallet 400 is set upon the third pallet 300. More specifically, the outer support surface 34 of the first leg 14 and the second leg 16 of the fourth pallet 400 are engaged with the outer upper seating surface 64 of the first shoulder 56 and the second shoulder 58 of third pallet 300.

As best seen in FIG. 10, a width of the outer upper seating surface 64 may be wider than the outer support surface 34. This configuration provides a tolerance for the side-to-side alignment of two stacked, unloaded pallets. For example, the second pallet 200 may be offset a small distance from the first pallet 100 without disengaging one another. In other words, the second pallet 200 does not have to be in perfect alignment with the first pallet 100 to remain engaged therewith. Further, the inner upper seating surface 62 of the first pallet 100 restricts lateral movement of the second pallet 200 relative to the first pallet 100 such that the first leg 14 of the second pallet 200 does not disengage from the first shoulder 56 of the first pallet 100. In addition, the inner upper seating surface 62 of the first pallet 100 guides the first leg 14 of the second pallet 200 into engagement with outer upper seating surface 64 of the first shoulder 56 of the first pallet 100 when the second pallet 200 is being positioned atop the first pallet 100.

In part, the nesting described above may be provided by the relative angles of the seating surfaces of stacked pallets 10. For example, the lower seating surface 36 of the first leg 14 and the inner upper seating surface 62 of the first shoulder 56 may extend at different angles from the outer support surface 34 of the first leg 14 and the outer upper seating surface 64 of the first shoulder 56. As seen in FIG. 10, the lower seating surface 36 extends at an angle $\alpha$ relative to the outer support surface 34 while the inner upper seating surface 62 extends at an angle $\beta$ relative to the outer upper seating surface 64, as viewed from the front or rear of the pallet 10. In aspects, the angle $\beta$ may be greater than the angle $\alpha$ in order to provide the alignment and nesting discussed above while permitting ease of stacking of adjacent pallets over minimum clearance.

Figure 11:
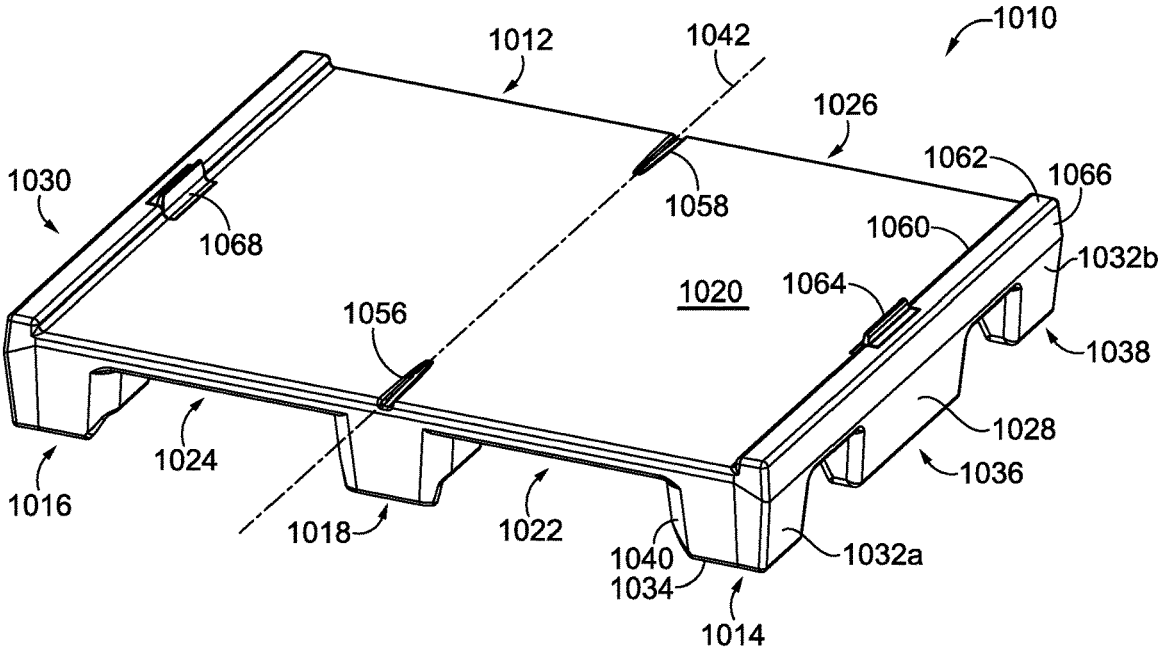
FIG. 11 depicts a perspective view of a pallet from above, in accordance with aspects hereof.

The pallet illustrated in FIGS. 11-22 may be similar to the pallet illustrated in FIGS. 1-10. For example, as seen in FIG. 11, the pallet 1010 may include a deck and a plurality of legs extending downwardly from the deck. Unlike the aspects discussed above, however, the pallet 1010 may comprise one or more alignment members for providing a connection between pallets that are in a stacked condition (e.g., stacked atop another). Further, the plurality of legs are a different shape than aspects discussed above. As previously stated, although described herein in reference to half-barrel kegs, this disclosure also applies to any cylindrical cargo loaded on a pallet.

Turning now to the figures generally, a pallet 1010 is depicted from different perspectives in an unloaded state. The pallet 1010 is configured to be loaded with up to four half-barrel kegs in a two-by-two configuration. Once loaded, a second pallet (see FIG. 6) may be positioned atop the half-barrel keys where it, too, may be loaded with up to four half-barrel kegs. Thus, a bottom structure of the pallet 1010 must include portions adapted to cooperate with half-barrel kegs in a way that the second pallet can also be loaded with additional half-barrel kegs. As more fully described below, the pallet 1010 may include a plurality of legs having multiple support surfaces (e.g., a ground contacting surface and a keg lip contacting surface). As previously noted, the pallet 1010 positioned on the bottom of the stack must be strong enough to withstand the weight of the entire stack. Thus, each leg may have multiple support surfaces to inhibit the pallet from bowing.

The pallet 1010 includes a deck 1012, a first leg 1014 positioned on a first side 1028 of the pallet 1010, a second leg 1016 position on a second side 1030 of the pallet 1010, and a third leg 1018, which may be positioned proximate a center line 1042 of the pallet 1010 in a front-to-back direction. In aspects, the second leg 1016 is a mirror image of the first leg 1014. Additionally, the pallet 1010 further includes a fourth leg 1036 and a fifth leg 1038, which are positioned on the first side 1028 with the first leg 1014 and a sixth leg 1048 and a seventh leg 1050, which are positioned on the second side 1030 with the second leg 1016. Additionally, an eighth leg 1052 and a ninth leg 1054 are provided proximate the center line 1042 along with the third leg 1018.

Figure 12:
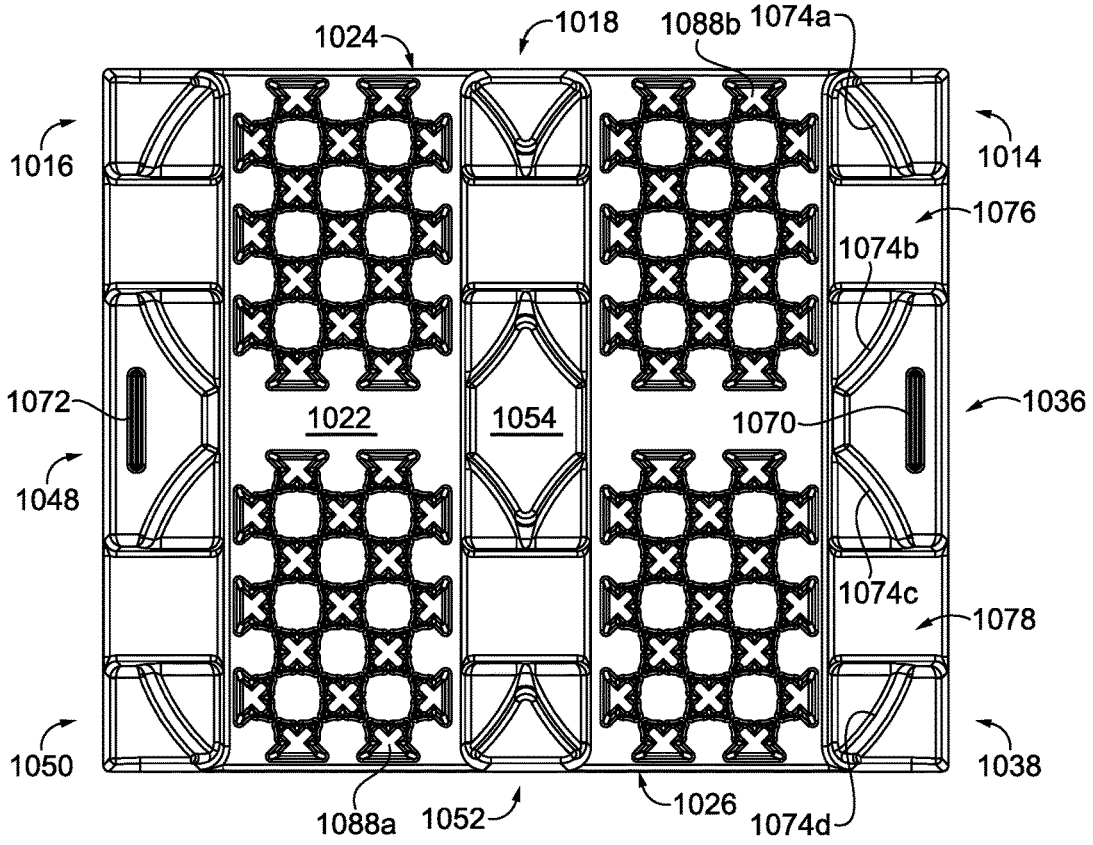
FIG. 12 depicts a bottom view of the pallet from FIG. 11, in accordance with aspects hereof.
Figure 13:
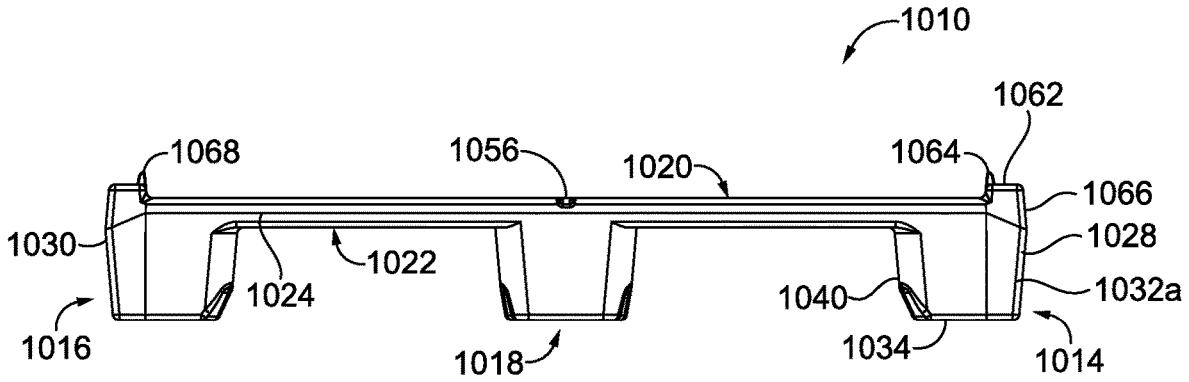
FIG. 13 depicts a front elevation view of the pallet from FIG. 11, in accordance with aspects hereof.
Figure 14:
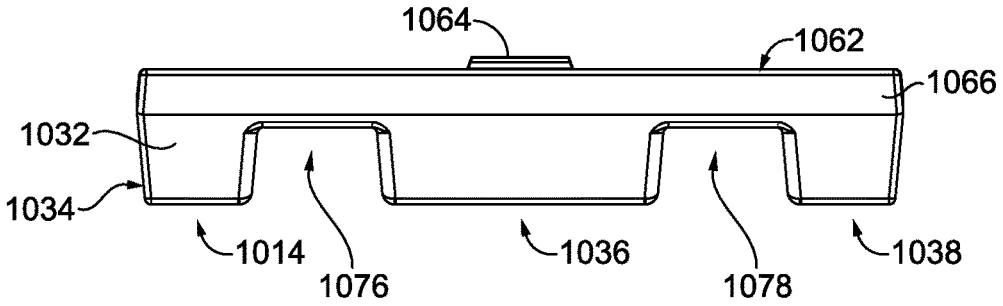
FIG. 14 depicts a side elevation view of the pallet from FIG. 11, in accordance with aspects hereof.
Figure 15:
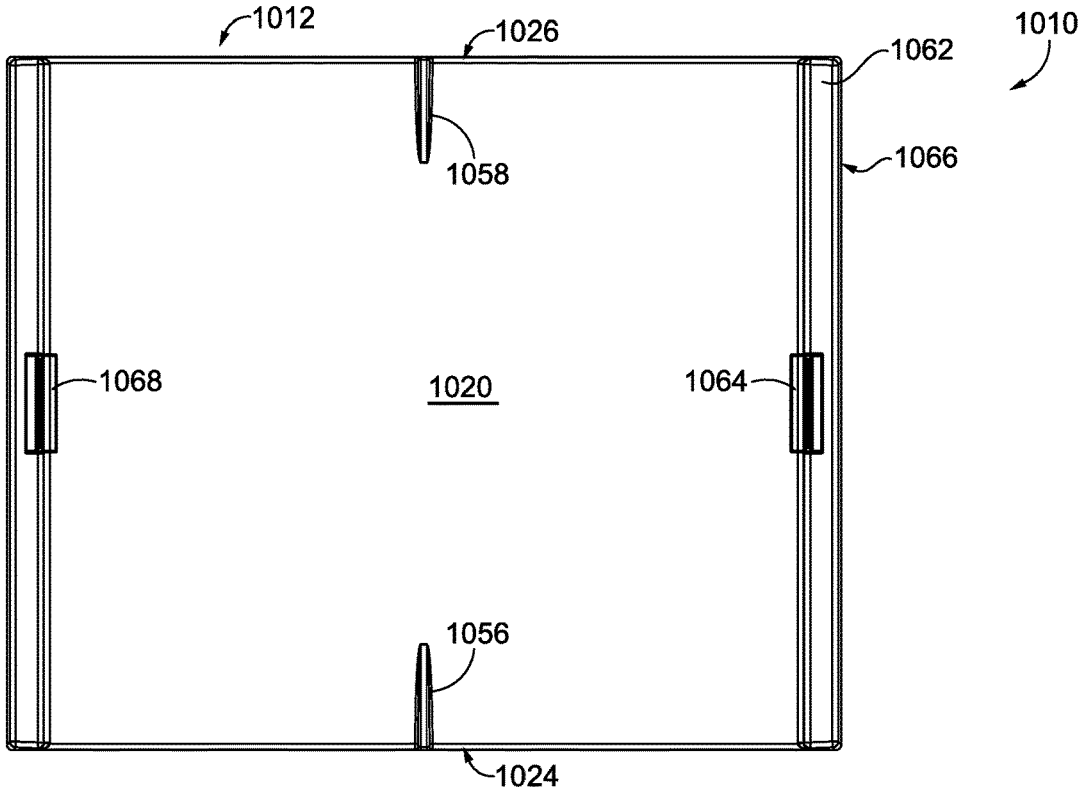
FIG. 15 depicts a top view of the pallet from FIG. 11, in accordance with aspects hereof.
Figure 16:
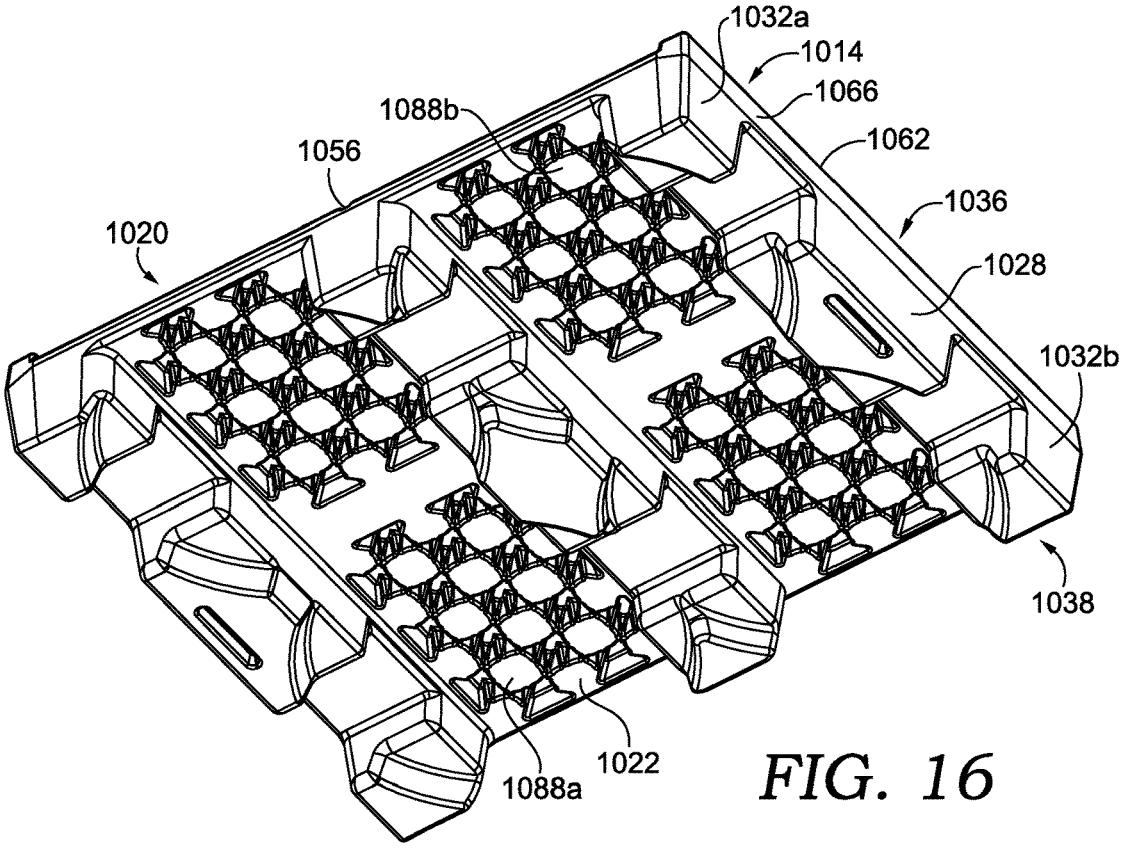
FIG. 16 depicts a perspective view of the pallet from FIG. 11 from below, in accordance with aspects hereof.
Figure 17:
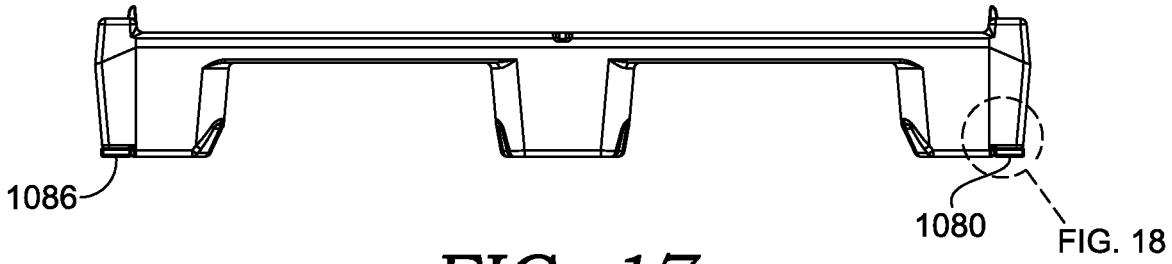
FIG. 17 depicts a front elevation view of a pallet including stringers, in accordance with aspects hereof.

The deck includes a top surface 1020 opposite a bottom surface 1022 and extends from the top surface 1020 to the bottom surface 1022 in a vertical direction, from a front side 1024 to a rear side 1026 in a front-to-back direction, and from a first side 1028 to a second side 1030 in a side-to-side direction. As described above, some illustrated aspects depict the deck 1012 as being solid. In other aspects, as shown in FIG. 12, the bottom surface 1022 may not be solid (e.g., a continuous structure) and may include structures that provide an effective bottom surface in order to save material (e.g., as shown in FIG. 12 where the bottom surface 1022 includes a plurality of recesses or grooves such as recess 1088*a* and recess 1088*b*). Alternatively, the deck 1012 could include apertures, channels, slots, perforations, etc.

Further, the deck 1012 may include one or more channels, shown as a first channel 1056 and a second channel 1058, extending through at least a portion of the deck 1012, such that liquid may be encouraged to drain off of portions of the top surface 1020 (previously mentioned as drain ports). As shown in FIG. 11, the first channel 1056 and the second channel 1058 may be proximate the center line 1042.

The deck 1012 includes a plurality of legs for support. The first leg 1014 extends downwardly from the bottom surface 1022 of the deck 1012. In the illustrated aspect, the first leg 1014 includes a front outer leg vertical surface 1032*a* extending downwardly to a lower support surface 1034. The lower support surface 1034 is configured to engage a surface upon which the pallet 1010 is placed upon when not atop half-barrel kegs (e.g., a warehouse floor). Extending upwardly from the lower support surface 1034 is an inner leg vertical surface 1040 that returns to the bottom surface 1022 of the deck 1012.

The second leg 1016 may include an identical structure to that disclosed with respect to the first leg 1014, mirrored across the center line 1042 of the pallet 1010. For sake of brevity, a description of this duplicate structure of the second leg 1016 will not be repeated. Additionally, the same can be said of the fifth leg 1038 and the seventh leg 1050 of the pallet 1010. The fourth leg 1036 and the sixth leg 1048 are situated between the first leg 1014 and the fifth leg 1038 and the second leg 1016 and the seventh leg 1050, respectively. The fourth leg 1036 and the sixth leg 1048 also extend downwardly from the bottom surface 1022 of the deck 1012.

While previous aspects of FIGS. 1-10 illustrated the first leg 14 and the second leg 16 as a solid structure extending from the front side 24 to the rear side 26 and integral to the deck 12, additional aspects described herein and shown in FIGS. 11-22 depict the first leg 1014 and the second leg 1016 extending only a portion of the distance between the front side 1024 and the rear side 1026. The fifth leg 1038 and the seventh leg 1050 are similarly configured to extend only a portion of the distance between the front side 1024 and the rear side 1026 at a distance that is equal to the distance extended by the first leg 1014 and the second leg 1016. Similarly, the fourth leg 1036 and the sixth leg 1048 extend only a portion of the distance between the front side 1024 and the rear side 1026. The fourth leg 1036 and the sixth leg 1048 can extend a distance equal to or larger than the distance extended by the first leg 1014, second leg 1016, fifth leg 1038, and the seventh leg 1050.

By extending only a portion of the distance between the front side 1024 and the rear side 1026, the pallet 1010 is configured as a 4-way entry pallet, meaning that a forklift or hand truck (or any other relevant machinery for moving pallets) can engage, or get under to lift, a pallet from all four sides. In other words, a forklift could lift pallet 1010 by entry from any one of the front side 1024, the rear side 1026, the first side 1028, and the second side 1030.

Similarly, the third leg 1018, the eighth leg 1052, and the ninth leg 1054 also extend downwardly from the bottom surface 1022 of the deck 1012. The third leg 1018 may be generally centered on pallet 1010. As described with respect to the first leg 1014, the third leg 1018 extends only a portion of the distance between the front side 1024 and the rear side 1026 to allow for 4-way entry. The third leg 1018 and the second leg 1016 each extend the same distance between the front side 1024 and the rear side 1026 as the first leg 1014 such that a first channel 1076 and a second channel 1078 are present. Accordingly, the fifth leg 1038, seventh leg 1050, and eighth leg 1050 each extend the same distance between the front side 1024 and the rear side 1026 as one another. Further, the fourth leg 1036, sixth leg 1048, and ninth leg 1054 also extend the same distance between the front side 1024 and the rear side 1026 as one another. The fourth leg 1036, sixth leg 1048, and ninth leg 1054 can extend a distance between the front side 1024 and the rear side 1026 that is equal to or greater than the distance of each of the other legs (i.e., the fourth leg 1036, sixth leg 1048, and ninth leg 1054 may extend a distance greater than that of the first leg 1014, second leg 1016, third leg 1018, fifth leg 1038, seventh leg 1050, and eighth leg 1052).

The first channel 1076 extends laterally the entire distance from the first side 1028 to the second side 1030. The first channel 1076 extends from the first leg 1014, the second leg 1016, and the third leg 1018 to the fourth leg 1036, the sixth leg 1048, and the ninth leg 1054, in a front-to-back direction. Similarly, the second channel 1078 extends laterally from the first side 1028 to the second side 1030. The second channel 1078 extends from the fifth leg 1038, the seventh leg 1050, and the eighth leg 1052 to the fourth leg 1036, the sixth leg 1048, and the ninth leg 1054, in a front-to-back direction.

The pallet 1010 also includes the ninth leg 1054 extending downwardly from the bottom surface 1022 of the deck 1012. The ninth leg 1050 may be generally centered on pallet 1010. The ninth leg 1050 can be configured to receive a plurality of half-barrel kegs. As shown in FIG. 12, each leg is configured to receive or interface with at least one half-barrel keg as is shown by receiving surfaces 1074*a*, 1074*b*, 1074*c*, and 1074*d*. For brevity, the receiving surfaces 1074*a-d* are only shown with respect to the first leg 1014, the fourth leg 1036, and the fifth leg 1038. However, as is clearly depicted, each of the legs includes one or more receiving surfaces. As is shown, the legs positioned in a corner of the pallet 1010 are configured with a single receiving surface to interface with a single half-barrel keg. Specifically, the first leg 1014, the second leg 1016, the fifth leg 1038, and the seventh leg 1050 all include one receiving surface, such as receiving surface 1074*a* and 1074*d*. In contrast, the third leg 1018, the eighth leg 1052, the fourth leg 1036, and the sixth leg 1048 are each configured with two receiving surfaces (such as 1074*b* and 1074*c*) to interface with (or touch) two half-barrel kegs. Finally, the centermost leg, shown here as the ninth leg 1054, is configured with four receiving surfaces such that it interfaces with four half-barrel kegs at one time. As described, it should be understood that at least a portion of each of the half-barrel kegs extends beyond that of the front side 1024 and/or rear side 1026.

The deck 1012 may also include a first alignment member 1064 and a second alignment member 1068 (refer to FIG. 11), which provide a connection between a bottom pallet and a pallet stacked atop the bottom pallet. As is more clearly seen in FIG. 12, each of the fourth leg 1036 and the sixth leg 1048 includes a first receiving recess 1070 and a second receiving recess 1072 to receive the first alignment member 1064 and the second alignment member 1068, respectively. An inner vertical surface 1060 (shown in FIGS. 11 and 13) extends upwardly from the top surface 1020. The inner vertical surface 1060 terminates at an upper support surface

1062 extending from the inner vertical surface 1060 to an outer vertical surface 1066, which extends from the front side 1024 to the rear side 1026 and engages at least the outer leg vertical surface 1032*a* of the first leg 1014 to an outer leg vertical surface 1032*b* of the fifth leg 1038. The first alignment member 1064 may be generally centered along the upper support surface 1062 and extend upwardly for engagement with a receiving recess.

Figure 18:
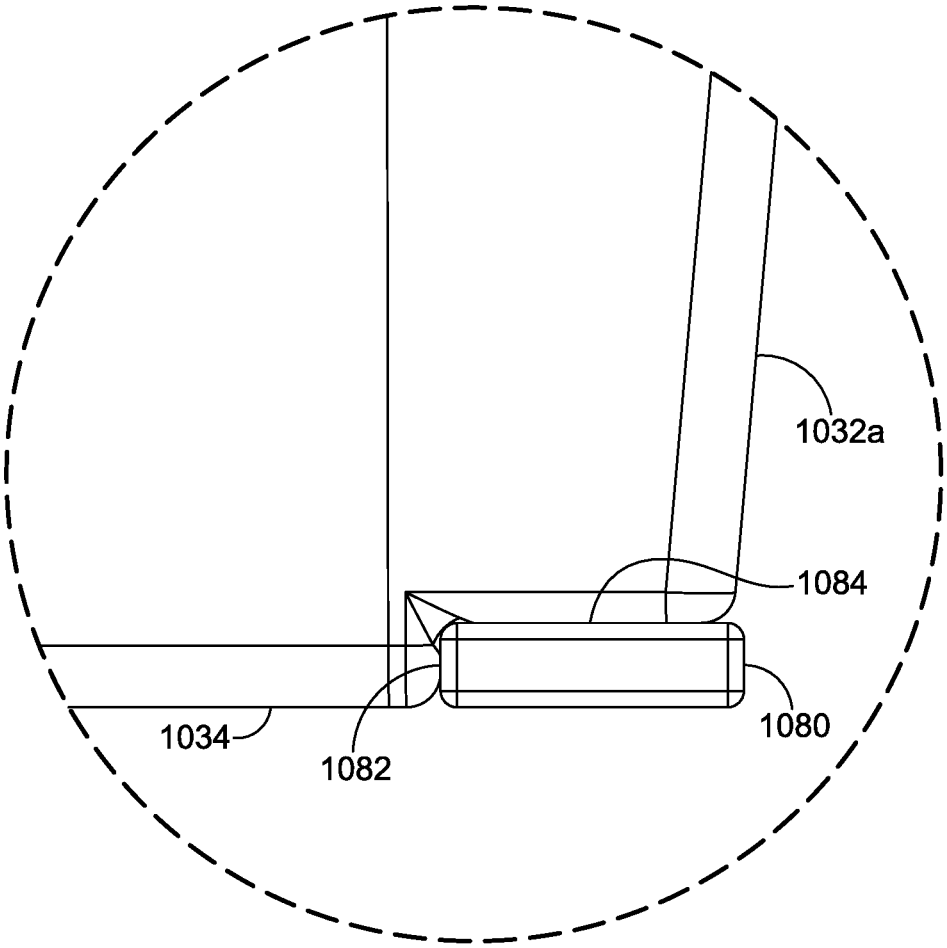
FIG. 18 depicts a section view of a first leg of a first pallet including a stringer, in accordance with aspects hereof.
Figure 19:
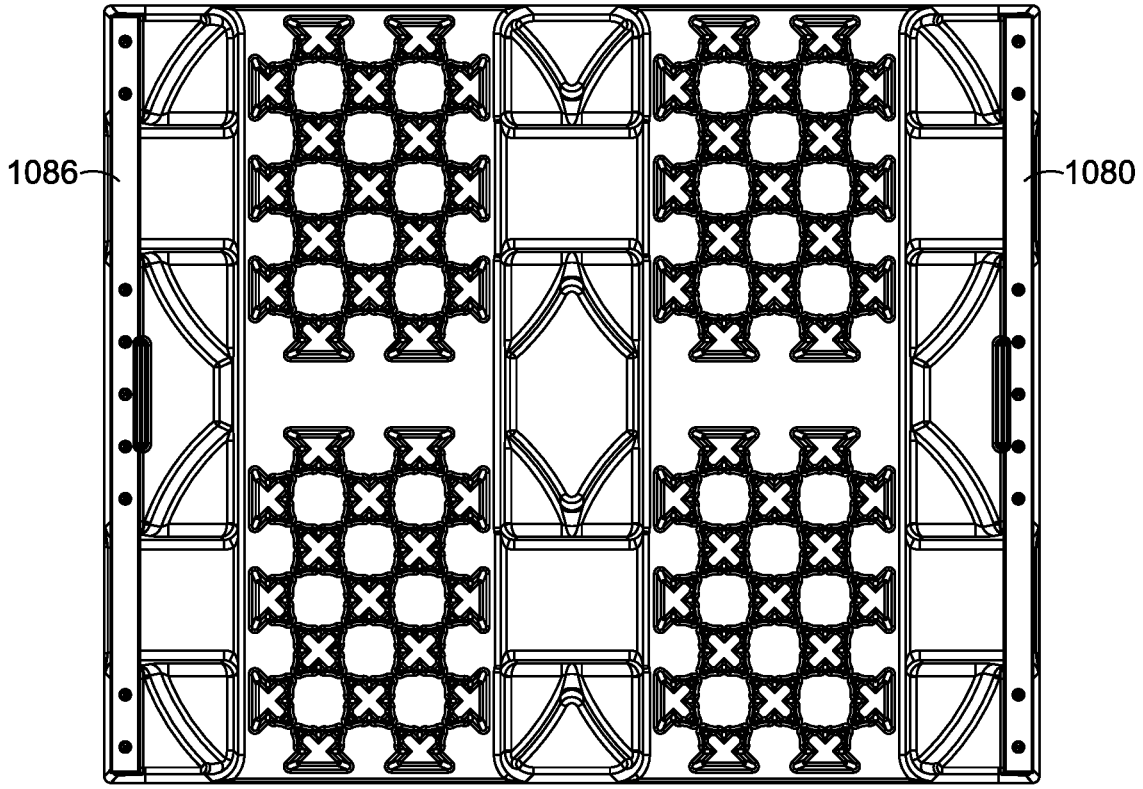
FIG. 19 depicts a bottom view of the pallet from FIG. 17, in accordance with aspects hereof.
Figure 20:
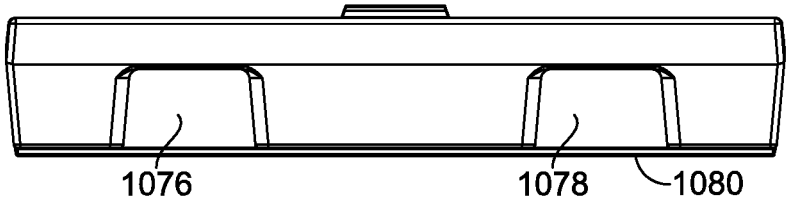
FIG. 20 depicts a side elevation view of the pallet from FIG. 17, in accordance with aspects hereof.
Figure 21:
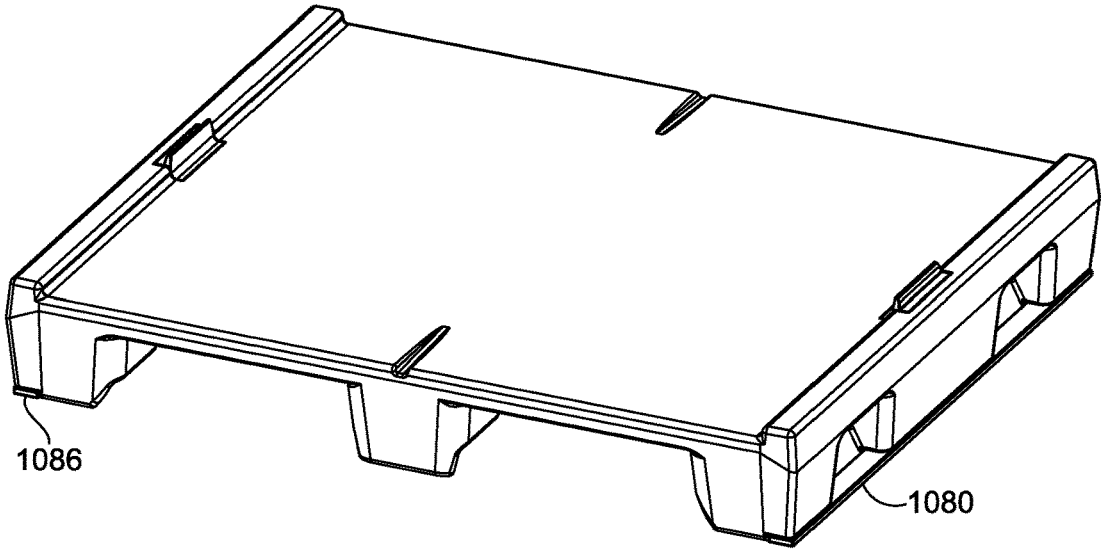
FIG. 21 depicts a perspective view of the pallet from FIG. 17 from above, in accordance with aspects hereof.
Figure 22:
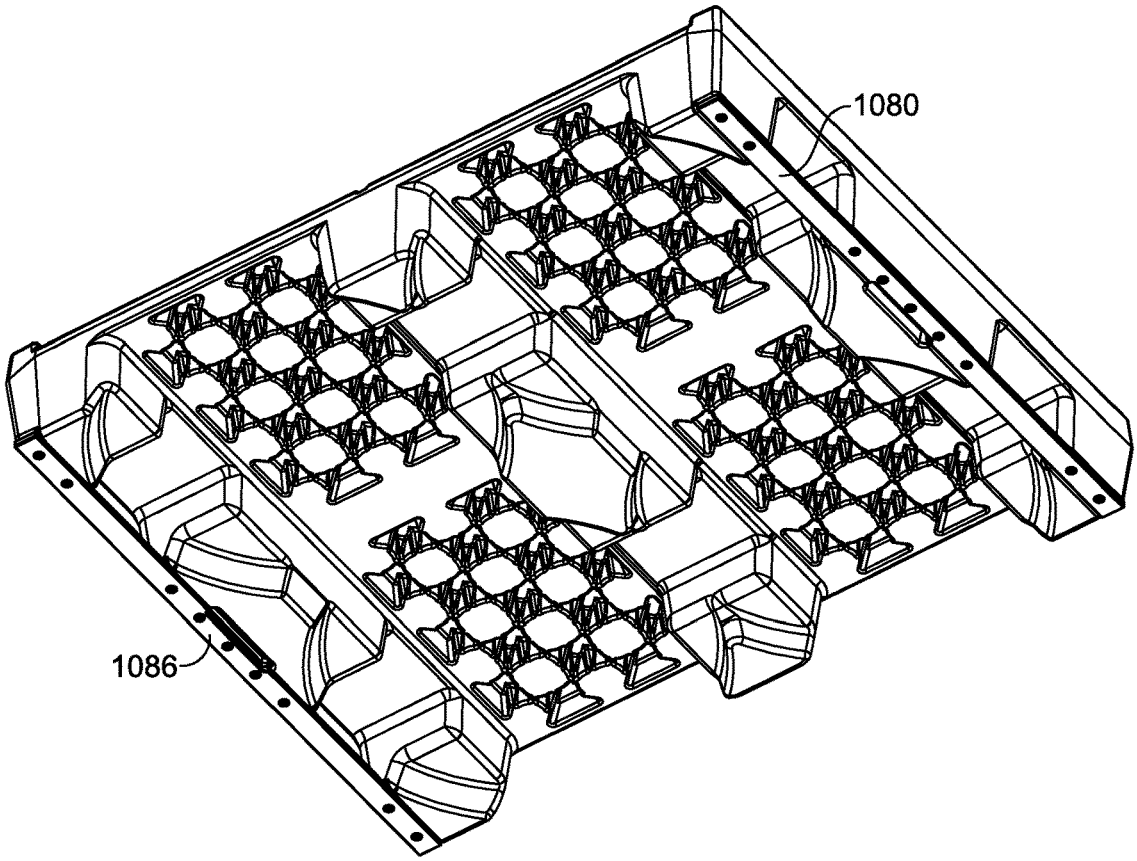
FIG. 22 depicts a perspective view of the pallet from FIG. 17 from below, in accordance with aspects hereof.

Turning now to FIGS. 17-22, a similar aspect is illustrated as discussed above. In aspects provided in FIGS. 17-22, a first stringer 1080 and a second stringer 1086 are provided. Each of the first stringer 1080 and the second stringer 1086 may increase the stability of the base for the pallet 1010. FIG. 18 illustrates the first stringer 1080 aligned with each of the outer leg vertical surface 1032*a* and the lower support surface 1034. In other words, the first stringer 1080 (and the second stringer 1086, not shown in FIG. 18) is flush with the lower support surface 1034 and the outer leg vertical surface 1032*a*, such that the first stringer 1080 does not extend beyond the outer leg vertical surface 1032*a*. Rather, the first stringer 1080 abuts an inner relief surface 1082 and an upper relief surface 1084 that are inserted into, for example, the first leg 1014 to create a recess for receiving the first stringer 1080. Similar views of the stringer are illustrated in FIGS. 19-22, including a bottom view with stringers, a side view with stringers also illustrating the first channel 1076 and the second channel 1078, and a perspective view from above with stringers.

EXAMPLE CLAUSES

The following are example clauses representing aspects contemplated herein:

Clause 1: A pallet comprising: a deck having an upper surface opposite a lower surface; a shoulder extending from the upper surface, the shoulder having an inner vertical surface, an inner upper seating surface, an outer upper seating surface, and an outer vertical surface; and a leg extending from the lower surface, the leg having an outer leg vertical surface, an outer support surface, a lower seating surface, an inner support surface, and an inner leg vertical surface.

Clause 2: The pallet of Clause 1, wherein the deck is comprised of a polymeric composition.

Clause 3: The pallet of Clause 1 or Clause 2, wherein the deck upper surface has a rectangular shape and includes a front side opposite a rear side and a first side opposite a second side.

Clause 4: The pallet of Clause 3, wherein each of the shoulder and the leg extend from the front side to the rear side.

Clause 5: The pallet of any of Clauses 1-4, wherein the leg and the shoulder are each integral to the deck.

Clause 6: The pallet of Clause 3, wherein the deck includes a deck vertical surface on the first side in vertical alignment with each of the outer leg vertical surface and the outer vertical surface of the shoulder.

Clause 7: The pallet of any of Clauses 1-6, wherein the lower seating surface is positioned between the outer support surface and the inner support surface.

Clause 8: The pallet of Clause 3, wherein the leg comprises a first leg and the shoulder comprises a first shoulder, the pallet further comprising: a second shoulder extending from the upper surface, the second shoulder having reciprocal surfaces to the first shoulder, mirrored across a center line of the deck; a second leg extending from the lower surface, the second leg having reciprocal surfaces to the first leg, mirrored across the center line of the deck, wherein the first leg and the first shoulder are each positioned proximate the first side and the second leg and the second shoulder are positioned proximate the second side, and wherein the second leg and the second shoulder are each joined to the deck.

Clause 9: The pallet of Clause 8, further comprising: a third leg extending from the lower surface, the third leg having a first side vertical surface, an upper support surface, and a second side vertical surface; and at least one foot extending from the upper support surface, the at least one foot each having a side surface and a lower support surface at least one foot extending from the upper support surface, the at least one foot each having a side surface and a lower support surface, wherein the third leg is centered between the first leg and the second leg.

Clause 10: The pallet of Clause 9, wherein the at least one foot comprises a full foot aligned with a center of the lower surface, a front half foot having a portion aligned with the front side of the deck, and a rear half foot having a portion aligned with the rear side of the deck.

Clause 11: The pallet of Clause 9 or Clause 10, wherein the inner support surface of both the first leg and the second leg and the upper support surface of the third leg are each spaced away from the lower surface of the deck an equal distance.

Clause 12: The pallet of any of Clauses 9-11, wherein the lower support surface of the at least one foot and the outer support surface of each of the first leg and the second leg are spaced away from the lower surface of the deck an equal distance.

Clause 13: The pallet of any of Clauses 1-12, wherein the upper surface has a greater surface roughness than the lower surface.

Clause 14: The pallet of any of Clauses 1-13, further comprising a drain port extending through the deck from the upper surface to the lower surface.

Clause 15: The pallet of any of Clauses 1-14, wherein a combined outer width of the outer support surface and the lower seating surface is equal to an inner width of the inner support surface.

Clause 16: The pallet of any of Clauses 1-15, wherein a lower angle between the outer support surface and the lower seating surface is less than an upper angle between the inner upper seating surface and the outer upper seating surface.

Clause 17: The pallet of any of Clauses 1-16, wherein a height of the inner vertical surface is less than a difference in distance the outer support surface and the inner support surface are spaced away from the lower surface.

Clause 18: A pallet stacking system comprising: a first pallet and a second pallet, each of the first pallet and the second pallet comprising: a deck having an upper surface opposite a lower surface; a shoulder extending from the upper surface, the shoulder having an inner vertical surface, an inner upper seating surface, an outer upper seating surface, and an outer vertical surface; and a leg extending from the lower surface, the leg having an outer leg vertical surface, an outer support surface, a lower seating surface, an inner support surface, and an inner leg vertical surface, wherein when the first pallet is stacked atop the second pallet, the outer support surface of the leg of the first pallet engages the outer upper seating surface of the shoulder of the second pallet.

Clause 19: A pallet comprising: a deck having an upper surface opposite a lower surface; a plurality of legs extending from the lower surface, each of the legs extending only a portion of a distance from a front side to a rear side of the deck; and a channel extending laterally from a first side to a second side.

Clause 20: A pallet of Clause 19, wherein the pallet comprises one or more stringers.

Additionally, although some exemplary implementations of the embodiments described herein are shown in the accompanying figures, these implementations are not intended to be limiting. Rather, it should be understood that the various embodiments and aspects described herein may be implemented upon any mower having a cutting deck suspended therefrom.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

What is claimed is:

1. A pallet comprising:

a deck having an upper surface opposite a lower surface;

a shoulder extending from the upper surface, the shoulder having an inner vertical surface, an inner upper seating surface, an outer upper seating surface, and an outer vertical surface, the inner vertical surface extending beyond the upper surface of the deck further than the outer vertical surface; and a leg extending from the lower surface, the leg having an outer leg vertical surface, an outer support surface, a lower seating surface, an inner support surface, and an inner leg vertical surface.

2. The pallet of claim 1, wherein the deck is comprised of a polymeric composition.

3. The pallet of claim 1, wherein the deck upper surface has a rectangular shape and includes a front side opposite a rear side and a first side opposite a second side.

4. The pallet of claim 3, wherein each of the shoulder and the leg extend from the front side to the rear side.

5. The pallet of claim 3, wherein the deck includes a deck vertical surface on the first side in vertical alignment with each of the outer leg vertical surface and the outer vertical surface of the shoulder.

6. The pallet of claim 3, wherein the leg comprises a first leg and the shoulder comprises a first shoulder, the pallet further comprising:

a second shoulder extending from the upper surface, the second shoulder having reciprocal surfaces to the first shoulder, mirrored across a center line of the deck;

a second leg extending from the lower surface, the second leg having reciprocal surfaces to the first leg, mirrored across the center line of the deck, wherein the first leg and the first shoulder are each positioned proximate the first side and the second leg and the second shoulder are positioned proximate the second side, and wherein the second leg and the second shoulder are each joined to the deck.

7. The pallet of claim 6, further comprising:

a third leg extending from the lower surface, the third leg having a first side vertical surface, an upper support surface, and a second side vertical surface; and at least one foot extending from the upper support surface, the at least one foot each having a side surface and a lower support surface, wherein the third leg is centered between the first leg and the second leg.

8. The pallet of claim 7, wherein the at least one foot comprises a full foot aligned with a center of the lower surface, a front half foot having a portion aligned with the front side of the deck, and a rear half foot having a portion aligned with the rear side of the deck.

9. The pallet of claim 7, wherein the inner support surface of both the first leg and the second leg and the upper support surface of the third leg are each spaced away from the lower surface of the deck an equal distance.

10. The pallet of claim 7, wherein the lower support surface of the at least one foot and the outer support surface of each of the first leg and the second leg are spaced away from the lower surface of the deck an equal distance.

11. The pallet of claim 1, wherein the leg and the shoulder are each integral to the deck.

12. The pallet of claim 1, wherein the lower seating surface is positioned between the outer support surface and the inner support surface.

13. The pallet of claim 1, wherein the upper surface has a greater surface roughness than the lower surface.

14. The pallet of claim 1 further comprising a drain port extending through the deck from the upper surface to the lower surface.

15. The pallet of claim 1, wherein a combined outer width of the outer support surface and the lower seating surface is equal to an inner width of the inner support surface.

16. The pallet of claim 1, wherein a lower angle between the outer support surface and the lower seating surface is less than an upper angle between the inner upper seating surface and the outer upper seating surface.

17. The pallet of claim 1, wherein a height of the inner vertical surface is less than a difference in distance the outer support surface and the inner support surface are spaced away from the lower surface.

18. A pallet stacking system comprising:

a first pallet and a second pallet, each of the first pallet and the second pallet comprising:

(1) a deck having an upper surface opposite a lower surface;

(2) a shoulder extending from the upper surface, the shoulder having an inner vertical surface, an inner upper seating surface, an outer upper seating surface, and an outer vertical surface, the inner vertical surface extending beyond the upper surface of the deck further than the outer vertical surface; and (3) a leg extending from the lower surface, the leg having an outer leg vertical surface, an outer support surface, a lower seating surface, an inner support surface, and an inner leg vertical surface, wherein when the first pallet is stacked atop the second pallet, the outer support surface of the leg of the first pallet engages the outer upper seating surface of the shoulder of the second pallet.

19. A pallet comprising:

a deck having an upper surface opposite a lower surface;

a plurality of legs extending from the lower surface, each of the legs extending only a portion of a distance from a front side to a rear side of the deck, wherein each of the plurality of legs includes at least one receiving surface recessed for engaging with at least one half-barrel keg and a lower support surface, the plurality of legs nestingly receive the half-barrel keg, and the plurality of legs constrain the half-barrel keg from moving front to rear and side to side relative to the deck; and a channel extending laterally from a first side to a second side.

20. The pallet of claim 19, wherein the pallet comprises one or more stringers including a ground contact surface coplanar with the lower support surface of the plurality of legs.

* * * * *